US008507838B2

(12) United States Patent
Andrews et al.

(10) Patent No.: US 8,507,838 B2
(45) Date of Patent: Aug. 13, 2013

(54) MICROSTRUCTURE PHOTOMULTIPLIER ASSEMBLY

(75) Inventors: Hugh Robert Andrews, Pembroke (CA); Edward T. H. Clifford, Deep River (CA); Marius Emanuel Facina, Deep River (CA); Harry Ing, Deep River (CA); Vernon Theodore Koslowsky, Deep River (CA); Darren Adam Locklin, Petawawa (CA); Martin Bernard Smith, Deep River (CA); Irina Stefania Stefanescu, Deep River (CA)

(73) Assignee: Bubble Technology Industries Inc., Chalk River, Ontario (CA)

( * ) Notice: Subject to any disclaimer, the term of this patent is extended or adjusted under 35 U.S.C. 154(b) by 284 days.

(21) Appl. No.: 12/940,366

(22) Filed: Nov. 5, 2010

(65) Prior Publication Data

US 2011/0133055 A1 Jun. 9, 2011

(30) Foreign Application Priority Data

Nov. 6, 2009 (CA) ..... 2684811

(51) Int. Cl.
*H01J 40/14* (2006.01)
*H01J 43/06* (2006.01)

(52) U.S. Cl.
USPC ..... 250/207; 313/103 R; 313/105 R

(58) Field of Classification Search
USPC ..... 250/207, 214 VT; 313/103 CM, 313/103 R, 105 CM, 105 R
See application file for complete search history.

(56) References Cited

U.S. PATENT DOCUMENTS 3,742,224 A * 6/1973 Einstein ..... 250/214 VT
5,378,960 A * 1/1995 Tasker et al. ..... 313/103 CM
5,402,034 A * 3/1995 Blouch et al. ..... 313/370
5,493,111 A * 2/1996 Wheeler et al. ..... 250/207
5,563,653 A * 10/1996 Floryan ..... 348/217.1
5,632,436 A * 5/1997 Niewold ..... 228/121
5,914,491 A * 6/1999 Salokatve et al. ..... 250/370.01
5,997,713 A * 12/1999 Beetz et al. ..... 205/124
6,198,090 B1 * 3/2001 Iosue ..... 250/214 VT
6,384,519 B1 * 5/2002 Beetz et al. ..... 313/103 CM
6,492,657 B1 * 12/2002 Burlefinger et al. ..... 257/10
6,522,061 B1 * 2/2003 Lockwood ..... 313/495
6,657,385 B2 * 12/2003 Tomasetti et al. ..... 313/527
6,667,472 B2 * 12/2003 Janeczko et al. ..... 250/214 VT (Continued)

OTHER PUBLICATIONS

Knoll, G.F., Radiation Detection and Measurement, third edition, John Wiley & Sons, 2000, Chapters 8,9, and 10, pp. 219-352.

(Continued)

*Primary Examiner* — John Lee
(74) *Attorney, Agent, or Firm* — McDonald Hopkins LLC

(57) ABSTRACT

The Microstructure Photomultiplier Assembly (MPA) enables the effective conversion of light signals (received at the front of the assembly) into readily-detectable electrical signals. The MPA comprises a photocathode, followed by an electron-multiplying plate(s) made from an insulating substrate which does not emit sufficient contaminants to poison the photocathode. Each plate is coated with a conductive layer. The front face of each plate is further coated with a layer of secondary electron-emissive material which, when struck by an incoming electron, can produce secondary electrons. Each plate is perforated with channels. The channels are designed to promote the efficient transfer and acceleration of electrons through the channels, under an applied voltage differential across the plate(s). An anode (pixelated or non-pixelated) at the end of the last plate collects the electrons and generates an electrical signal. The MPA is contained within a vacuum enclosure.

4 Claims, 2 Drawing Sheets

(56) References Cited

U.S. PATENT DOCUMENTS

| | | | | |
|---|---|---|---|---|
| 6,870,308 | B2 * | 3/2005 | Heo et al. | 313/103 R |
| 6,876,802 | B2 * | 4/2005 | Rosine et al. | 385/120 |
| 6,891,166 | B2 * | 5/2005 | Brahme et al. | 250/389 |
| 7,030,388 | B2 * | 4/2006 | Takagi et al. | 250/397 |
| 7,663,081 | B2 * | 2/2010 | Hahn et al. | 250/207 |
| 7,687,759 | B2 * | 3/2010 | Brown et al. | 250/214 VT |
| 7,973,485 | B1 * | 7/2011 | Brown et al. | 315/111.61 |
| 7,994,483 | B2 * | 8/2011 | Tamagawa et al. | 250/374 |
| 8,237,125 | B2 * | 8/2012 | Wang et al. | 250/370.01 |
| 2002/0175283 | A1 * | 11/2002 | Chang et al. | 250/315.3 |
| 2004/0206911 | A1 * | 10/2004 | Laprade | 250/397 |
| 2004/0245521 | A1 * | 12/2004 | Faris | 257/40 |
| 2004/0245925 | A1 * | 12/2004 | Yamauchi et al. | 313/532 |
| 2005/0122020 | A1 * | 6/2005 | Peck | 313/103 CM |
| 2005/0122021 | A1 * | 6/2005 | Smith | 313/103 CM |
| 2005/0122022 | A1 * | 6/2005 | Smith et al. | 313/103 CM |
| 2008/0251732 | A1 * | 10/2008 | Dick et al. | 250/382 |
| 2008/0283725 | A1 * | 11/2008 | Hahn et al. | 250/207 |
| 2009/0084972 | A1 * | 4/2009 | Tamagawa et al. | 250/374 |
| 2009/0212680 | A1 * | 8/2009 | Tremsin et al. | 313/103 R |
| 2009/0256063 | A1 * | 10/2009 | Sullivan et al. | 250/214 LA |
| 2009/0315443 | A1 * | 12/2009 | Sullivan et al. | 313/103 CM |
| 2010/0044577 | A1 * | 2/2010 | Sullivan et al. | 250/390.01 |
| 2010/0066245 | A1 * | 3/2010 | Van Spijker | 313/532 |
| 2011/0042577 | A1 * | 2/2011 | Andrews et al. | 250/392 |
| 2011/0133055 | A1 * | 6/2011 | Andrews et al. | 250/207 |

OTHER PUBLICATIONS

Wiza, Joseph Ladislas, Microchannel Plate Detectors, Nuclear Instruments and Methods, 162 (1979), pp. 587-601, North-Holland Publishing Co.

Charpak, G., Benaben, P., Breuil, P., Di Mauro, A., Martinengo, P., and Peskov, V., Development of New Hole-Type Avalanche Detectors and the First Results of Their Applications, IEEE Transactions on Nuclear Science, vol. 55, No. 3, Jun. 2008, pp. 1657-1663.

Sakurai, H., Tokanai, F., Gunji, S., Sumiyoshi, T. Fujita, Y., Okada, T., Sugiyama, H., Ohishi, Y., and Atsumi, T., Gain of a gas photomultiplier with CsI photocathode, 3rd Symposium on Large TPCs for Low Energy Rare Event Detection, Journal of Physics: Conference Series 65 (2007) 012020, IOP Publishing, pp. 1-5.

Sauli, F., Gem: A new concept for electron amplication in gas detectors, Nuclear Instruments and Methods in Physics Research A 386 (1997) 531-534, Elsevier Science B.V.

Chechik, Rachel and Berskin, Amos, Nuclear Instruments and Methods in Physics Research A, Nuclear Instruments and Methods in Physics Research A 595 (2008) 116-127, Elsevier B.V.

Breskin, A., Buzulutskov, A., Chechik, R., Singh, B.K. Bondar, A. and Shekhtman, L., Sealed GEM photomultiplier with a CsI photocathode: ion feedback and ageing, Nuclear Instruments and Methods in Physics Research A 478 (2002) 225-229, Elsevier Science B.V.

Periale, L., Peskov, V., Carlson, P., Francke, T. Pavlopoulos, P., Picchi, P., Pietropaolo, F., Detection of the primary scintillation light from dense Ar, Kr and Xe with novel photosensitive gaseous detectors, Nuclear Instruments and Methods in Physics Research A 478 (200) 377-383, Elsevier Science B.V.

Kaminski, Jochen, Kappler, Steffen, Ledermann, Bernhard, Muller, Thomas, and Ronan, Michael, Study of Various Anode Pad Readout Geometries in a GEM-TPC, IEEE Transactions on Nuclear Science, vol. 52, No. 6, Dec. 2005, pp. 2900-2906.

Balcerzyk, Marcin, Mormann, Dirk, Breskin, Amos, Singh, Bhartendu K., Freitas, Elisabete D. C., Chechik, Rachel, Klin, Moshe, and Rappaport, Michael, Methods of Preparation and Performance of Sealed Gas Photomultipliers for Visible Light, IEEE Transactions on Nuclear Science, vol. 50, No. 4, Aug. 2003, pp. 847-854.

Laprade, Bruce N., Prunier, Richard, and Farr, Reginald, The Developement of a Robust, Discrete Dynode Electron Multiplier Using Novel Secondary Electron Emissive Materials, Poster Paper 1340-17P, Presented at the Pittsburgh Conference 2005, Burle Electro-Optics Inc., Richard Leclercq, Burle Industries Mar. 2, 2005.

Rouki, C., Westerberg, L., and the CHICSi development group; Ultra-High Vacuum Compatibility Measurements of Materials for the CHICSi Detector System, 2003 Phys. Scr. 2003 107.

Adamyan, F., Avanesyan, H., Asatryan, M., Chatrchyan, S., Hagopian, V., Harutunyan, B., Haykazyan, M., Hovsepyan, A., Sirunyan, A., Shinkareva, L., Development and large-scale production of ceramic PCBs for the preshower detector of the CMS experiment, Nuclear Instruments and Methods in Physics Research A 551 (2005) 285-289.

Lyashenko, A.V., Breskin, A., Chechik, R., Veloso, J.F.C.A., Dos Santos, J.M.F. and Amaro, F.D., Development of high-gain gaseous photomultipliers for the visible spectral range, Published by IOP Publishing for SISSA, Jul. 3, 2009, pp. 1-22.

* cited by examiner

MICROSTRUCTURE PHOTOMULTIPLIER ASSEMBLY

CROSS REFERENCE TO RELATED APPLICATIONS

The present application claims priority to Canadian Patent Application No. 2,684,811 filed Nov. 6, 2009, which is incorporated by reference herein in its entirety.

FIELD OF THE INVENTION

The present invention, termed a Microstructure Photomultiplier Assembly (MPA) relates to the field of photo-detectors and in particular to devices commonly called photomultipliers or microchannel plates whose function is to convert a weak light signal, as may be emitted by certain radiation scintillators (e.g. a NaI(TI) crystal), to an electronic pulse that can be readily processed by conventional analogue and digital electronics. Such devices are also used in the detection of light signals associated with astronomy or optical communication.

BACKGROUND OF THE INVENTION

Detection of weak light signals is a common requirement in many areas of science and technology. The background that prompted the invention of the MPA is in the field of radiation detection, although the MPA has applications in other fields.

In the detection of radiation, one common method involves the use of scintillators (such as NaI(TI)). Good summaries of scintillators and their properties can be found in many standard reference books on radiation detection (e.g. G. F. Knoll, *Radiation Detection and Measurement*, third edition (John Wiley & Sons, 2000) Chapters 8, 9 and 10). When radiation such as a gamma ray, beta particle, alpha particle or neutron impinges the scintillator, the latter emits a short flash of light. This light is usually detected by a photomultiplier tube (PMT), or more recently, by a newer photodetector technology called a microchannel plate (MCP). The function of the PMT or MCP is to convert the weak light signal into a burst of electrons that is amplified to a level needed by conventional electronics used for pulse analysis. Both PMTs and MCPs operate in a vacuum because high-sensitivity photocathode materials (which perform the conversion of light to electrons) are extremely sensitive to gases that can chemically attack or "poison" the thin photocathode layer. This is particularly true for photocathode materials that are sensitive in the visible region of the optical spectrum, which are typically alkali metal based (e.g. S-11 photocathodes).

The application of high voltage to PMTs and MCPs creates strong electric fields that accelerate and focus the photoelectrons from the photocathode to strike an adjacent surface, coated with a special material that produces high secondary electron emissions, resulting in an increase in the number of electrons. Further amplification is done by repeating the electron bombardment process. In the PMT, this electron amplification is done by a series of "dynodes" which are conductive foils separated from each other, but connected by an electric field to accelerate and focus the electron burst to the receiving dynode. In a typical PMT, 8 to 12 dynodes are used to achieve electron gains in the order of $10^5$ to $10^8$. The amplified signal is collected on an anode—a conductive foil or a wire—from which the amplified electronic signal exits from the vacuum, ready for conventional electronic processing. In the MCP, the amplification is done inside microscopic channels, lined with the secondary electron emissive material. The channels are commonly at an angle to the face of the MCP to reduce positive ion feedback. The MCP is generally made of glass and the microchannels are typically 5-100 μm diameter, lined with PbO. The MCPs are made by fusing tiny glass tubes to form a boule and cutting the boule to a desired MCP thickness, usually at 8°-15°. A good description of MCPs is given by J. L. Wiza, Nucl. Instr. & Meth. 162 (1979) 587-601.

Due to technical and cost issues associated with their manufacturing processes, PMTs and MCPs are relatively small. PMTs are commonly only 2" to 3" in diameter, although large 20" diameter tubes have been made. Currently, MCPs are only commercially available in sizes up to approximately 3" in diameter. The complexity of manufacturing translates into fairly high costs for these devices, currently from several hundred dollars to well over a thousand dollars each. For certain applications, where large area detectors are required, the use of PMTs or MCPs can become prohibitively expensive.

Over the last two decades, the advent and widespread use of microelectronics has led to a technological revolution in economical manufacturing of various electronic sub-components. In particular, the production of circuit boards of various designs at reasonable volumes can be done for tens of dollars. One new radiation detection technology that has taken advantage of the low cost of modern circuit board production is the Gas Electron Multiplier (GEM), now used extensively for experiments in high-energy physics. A GEM (F. Sauli, Nucl. Instr. & Meth. A386 (1997) 531-534) consists essentially of a circuit board (a non-conducting substrate with a thin Cu layer on each side of the substrate) containing a regular array of tiny channels through the board. When a voltage is applied across the two sides of the board, strong electric field lines are formed through the channels. The GEM uses such a board in a gas medium, such as the type of gas (argon-methane) used in common gas counters. When radiation interacts with the gas, electron-ion pairs are produced. The electrons are guided to the closest channel and are accelerated by the electric field in the channel, where collisions with gas molecules inside the channel produce more electron-ion pairs. Thus, the channels in a GEM serve as tiny electron amplifiers and the GEM gas provides the agent for electron multiplication. Due to the small size of the channel, GEMs provide excellent spatial resolution for imaging charged particles transversing the gas. GEMs evolved from the use of large gas counters to detect high-energy charged particles and the need to define their trajectories in order to determine their energies and particular species. Recent advances in GEM technology have led to the thick GEM (THGEM) (L. Periale, V. Peskov, P. Carlson, T. Francke, P. Pavlopoulos, P. Picchi and F. Pietropaolo, Nucl. Instr. & Meth. A478 (2002) 377-383) and RETGEM (G. Charpak, P. Benaben, P. Breuil, A. Di Mauro, P. Martinengo and V. Peskov, IEE Trans. Nucl. Sci. 55 (2008) 1657-1663). These differ from the original GEM in the use of larger channels (~0.3 mm) and the coating of the ends of the channel with a higher resistivity material (relative to Cu) to allow for more robust operation.

An alternative current development of the GEM technology is being pursued by several groups (e.g. R. Chechik and A. Breskin, Nucl. Instr. & Meth. A595 (2008) 116-127; H. Sakurai, F. Tokanai, S. Gunji, T. Sumiyoshi, Y. Fujeta, T. Okada, H. Sugiyama, Y. Ohishi and T. Atsumi Jour. Phys. Conf. Series 65 (2007) 012020). These groups are working on the development of a gaseous photomultiplier based on GEM technology i.e. a GEM PMT. In essence, these groups are replacing the standard dynode structure of a PMT in a vacuum with a GEM assembly and its counting gas. The GEM PMT is housed inside a sealed enclosure that has a glass window not far from the board surface. The inside of the glass window (close to the board surface) is coated with a photocathode material, similar to that of a PMT. If a scintillator (e.g. NaI (TI)) is placed against the outside of the glass window, any scintillation from the radiation sensor (in the form of a weak light pulse) would pass through the glass window to impinge the photocathode. Electrons emitted by the photocathode would be drawn towards the board surface. These electrons would produce electron-ion pairs in the gas layer between the photocathode and the board. These electrons in turn would be guided into the channels of the board by the shaped electric field where further electron amplification occurs, identical to the operations of a GEM. If additional amplification is required, additional boards can be added to achieve the desired electron signal needed for conventional electronic processing. Some success with GEM PMTs has been achieved with CsI as the photocathode (A. Breskin, A. Buzutuskov, R. Chechik, B. K. Singh, A. Bondar and L. Shekhtman, Nucl. Instr. & Meth. A478 (2002) 225-229; A. V. Lyashenko, A. Breskin, R. Chechik, J. F. C. A. Veloso, J. M. F. Dos Santos, and F. D. Amaro, 2009 IOP Publishing Ltd. And SISSA, doi: 10.1088/1748-0221/4/07/PO7005) because it is not extremely reactive with contaminants in the counting gas. Unfortunately, CsI is sensitive to only UV radiation and not to visible light around 450 nm such as produced by many common scintillators. Attempts to develop gas PMTs for visible light have been met with limited success (M. Balcerzk, D. Mormann, A. Breskin, B. K. Singh, E. D. C. Freitas, R. Chechik, M. Klin and M. Rappaport, Trans. Nucl. Sci. 50 (2003) 847-854) because the reactivity of the K—Cs—Sb limits the stability of the photocathode to only a few months, despite care in avoiding contaminant poisons. There are ongoing efforts to try to protect the rare-earth photocathode by covering it under ultra-thin layers of less-reactive CsI.

SUMMARY OF THE INVENTION

The subject invention provides for a novel photomultiplier assembly, termed the Microstructure Photomultiplier Assembly (MPA), which enables the effective conversion of light signals (received at the front of the assembly) into readily-detectable electrical signals.

The MPA comprises a photocathode (which converts light into electrons and which is located in front of or on the front surface of the assembly), followed by an electron-multiplying plate, or series of plates, each made from an insulating substrate which does not emit sufficient contaminants to poison the photocathode. Each plate is coated on the front and rear faces with a conductive layer. In addition, the front face of each plate is further coated with a layer of secondary electron-emissive material which, when struck by an incoming electron, can produce secondary electrons. Each plate is perforated with channels (with non-conducting walls) and the number and geometry of these channels is designed to promote the efficient transfer and acceleration of electrons through the channel, under an applied voltage differential across the plate(s). The number of plates placed in series is determined by the desired degree of electron multiplication. At the exit of the last plate, an anode is located to collect the electrons and generate an electrical signal that can be read by conventional electronics. The anode can be a simple anode or can be a position-sensitive anode. The spacing between the photocathode, the electron-multiplying plates, and the anode is selected to promote the efficient transfer and acceleration of electrons across the assembly, as well as to promote the efficient production of secondary electrons.

The photocathode, electron-multiplying plate(s), and anode are all contained within a vacuum enclosure, which helps to protect the photocathode from poisoning due to contaminants. The enclosure may also contain getters (i.e. reactive materials which remove trace contaminants from within the enclosure) in order to extend the life of the photocathode. The portion of the vacuum enclosure in front of the photocathode is transparent to the incoming light signal.

The MPA can be produced in a range of sizes, depending on the required application.

BRIEF DESCRIPTION OF THE DRAWINGS

In the drawings, which form part of this specification.

DETAILED DESCRIPTION

Figure 1:
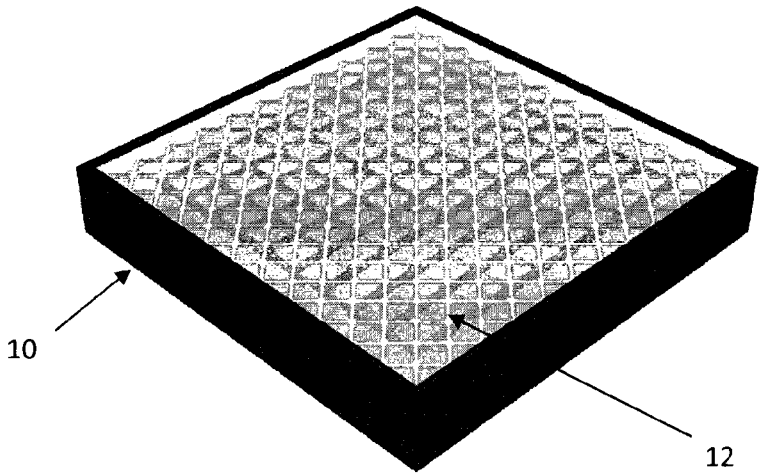
FIG. 1 illustrates the concept of the microstructure photomultiplier assembly.
Figure 1:
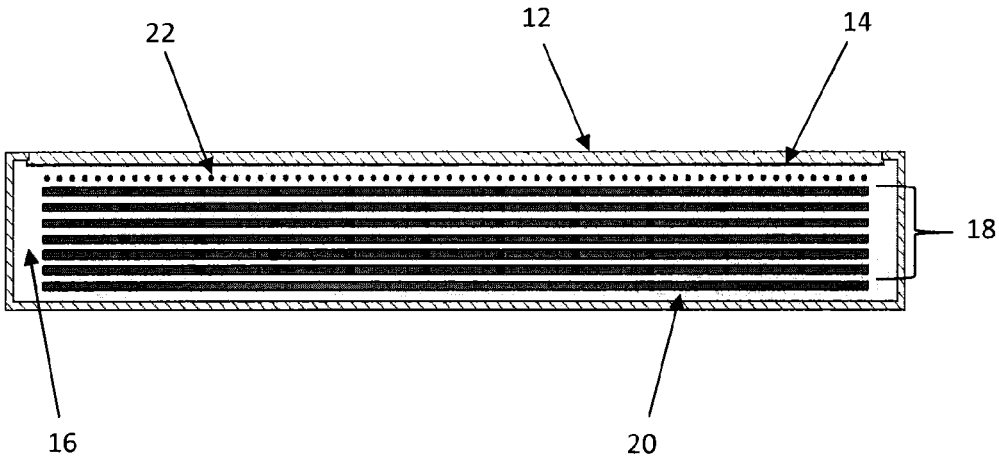

We propose to utilize circuit boards with small channels through them, similar to the basic component used by a GEM. However, we propose to deposit an additional layer of secondary electron emissive material on the conductive layer, among the holes, to form what is termed a multistructured board (MSB). This secondary emissive material can be a suitable alkali-based compound or a more robust compound that can be handled under non-vacuum conditions (e.g. see B. N. Laprade, R. Prunier and R. Farr, Poster paper 1340-17P, The Pittsburgh Conference 2005). This emissive material is only needed on one side of the board (the side facing the photocathode). The MPA is conceived to operate in a vacuum, like a conventional PMT. By applying a voltage across the board and maintaining a voltage between the photocathode and the front face of the MSB, photoelectrons from the photocathode will be drawn towards the board surface and be increased in energy by the electric field inside the channel. These higher energy electrons will strike the emissive layer of a second MSB, producing additional secondary electrons. These low-energy secondary electrons, in turn, will be drawn into the channel of the second board where they will be further accelerated by the electric field and so on, similar to the electron amplification process in a PMT. Unlike the GEM PMT, no electron-ion pairs are produced in the channel since there is no gas. However, the electrons will emerge from the channels of the MSB with additional energy provided by the electric field generated by the voltage across the board. This energy gain is similar to that between adjacent dynodes in the convention PMT. Thus, the channels of the MSB serve to increase the energy of the electrons that are entering the channel—similar to the electric field between dynodes. When these electrons strike the secondary emissive layer of the next board, they will produce additional secondary electrons—in similarity with the function of the next dynode. Thus, by using an array of MSBs all operated with a voltage difference between each board, electron amplification is achieved in a manner similar to a series of dynodes. Many layers of MSBs can be used to get a large enough electron signal. A board without channels can serve as the anode. The signal from the anode can exit from the MPA and be ready for processing by conventional electronics—identical to the way a PMT is used.

Recent advances in circuit boards technology make the MPA a viable, practical, timely product. The desired use of alkali metal-based photocathodes (for high quantum efficiency in the visible spectral region) requires operation in a high vacuum environment. Most traditional circuit boards are made on a pliable plastic substrate (e.g. woven glass and epoxy). While such boards have been shown to be usable under high vacuum conditions if properly "baked" at elevated temperatures (R. Rouki, L. Westerberg, and the CHICSi development group, Physica Scripta T104 107-108 (2003)), little work has been done in assessing the long-term outgassing of such boards that are based on plastic substrates. However, in recent years, circuit boards based on a ceramic substrate have become readily available and have been produced in large scale for research (e.g. Adamyan F., Avanesyan H., Asatryan M., Chatrchyan S., Hagopian V., Harutunyan B., Haykazyan M., Hovsepyan A., Sirunyan A. and Slinkareva L., (Nucl. Inst. Meth. A 551 (2005) 285-289) and by many commercial suppliers. Such circuit boards have gained the reputation of being easy to work with and can handle heating by electronic component well. For our application, ceramic-based circuit boards are ideal for high-vacuum operation. Thus, the combination of MSBs based on a ceramic substrate, and a photocathode, such as an alkali-metal photocathode, operated inside a chamber under high vacuum makes the MPA a sound, practical device for detection of weak light signals from any large area (e.g. >4"×4") scintillator, commonly used for detection of radiation.

Of course, the great advantage of the MPA is that the MSB can have many fine channels down to about 50 μm diameter range. Thus, similar to a GEM or a MCP, this fine collection of miniature amplifiers can be used for ultra-fine imaging applications if desired. For such an application, it is only necessary to segment the anode into isolated copper "islands", each covering one or more channels. By using anode pad read-out technology, spatial resolution in the tens of microns range can easily be achieved. Such readouts have already been developed for the GEM (e.g., Kaminski J., Kappler S., Leidermann B., Muller T. and Ronan M., IEEE Trans. Nucl. Sci. 52 (2005) 2900-2906.) and are commercially available. Such readouts can be readily applied to the MPA for imaging applications. Such applications are commonly found in medical imaging where high definition is extremely desirable.

While the MPA can be manufactured in a variety of sizes and shapes to suit a desired application, we propose a particular embodiment which is appropriate for use in wide area (e.g. 1 m×1 m) radiation imaging, of current interest in homeland security applications. Currently, the detectors used for x-ray or neutron imaging of vehicles and cargo containers are in the form of a thin vertical array. The interrogating beam is a line beam to match the detector array and the cargo is moved pass the interrogation beam and the vertical line image of the cargo is captured by the detector array. The 2-dimensional image of the entire cargo is created by the collection of such vertical images. The vertical detector array itself contains many individual radiation detectors. Often, scintillators are used and they all require PMTs or a solid state equivalent.

The use of large area detectors (instead of a vertical line detector) would increase the efficiency of the imaging process—similar to the use of an area detector in conventional chest x-rays. Unfortunately, the use of a large area detector based on current technology would increase the cost of the detector system enormously—primarily because of the large increase in the number of PMTs (or solid state equivalent) required.

The proposed embodiment of the MPA lowers the high cost for a large area detector considerably. We propose a MPA design based on a 12"×12"×2" module (to compared to a 12" PMT or by tiling of many smaller PMTs). Such a module provides a reasonable choice for tiling of larger areas (e.g. 1 m×1 m) while providing flexibility for various, large, geometric detector designs.

The proposed MPA module would be in the form of a square, preferably stainless steel, box 10 12"×12"×2" high, having a thick (−¼") glass plate 12 on the front face as shown in FIG. 1. This sealed enclosure must be strong enough to withstand atmospheric pressure with a high vacuum 16 within. The inside of the glass surface 12 would be coated with a conventional S-11 or similar photocathode 14, approximately 0.251Jm thick. The MPA may further include a conductive mesh 22 to accelerate photoelectrons. Three to more than a dozen MSBs 18 of thickness 1 mm with, say, 0.3 mm diameter channels at 0.7 mm pitch, each isolated from one another by ceramic insulator standoffs (2 mm thick), are placed adjacent to the photocathode (−2 mm distance). Each of the circuit boards (with ceramic substrate) have electrical connections to both sides of the board and these electrical leads allow the application of high voltage outside the MPA, similar to the pins that allow high voltage to be applied to the dynodes of a PMT. Thus each circuit board has 1 pair of external electrical connections. An anode plate 20 consisting of a circuit board without channels can be used to provide signal output. If imaging is not required, a single pin to the outside of the MPA from the anode 20 can be used for signal output. If imaging is required, the anode 20 can be segmented into as small areas as desired and these could take the form of a pad matrix (in PCB) that can be read out using a variety of pad readout technology such as charge division or commercial multi-channel readout Electronics for Nuclear Applications. The MPA is operated under high vacuum. In concept, the MPA can be used whenever there is a need for a large PMT, or in place of tiling large area scintillators with a number of smaller PMT (as is commonly done in "gamma cameras" used in medical diagnosis). Its operation requires a supply of high voltage (as for PMTs) and the use of preamplifiers and analogue/digital data processing electronics (as for PMTs). In fact, the MPA when used for imaging applications can be regarded as a much larger version of a commonly available multi-anode PMT or a MCP, often used whenever there is a need to have many independent electron amplifiers within a single electronic device.

Figure 2:
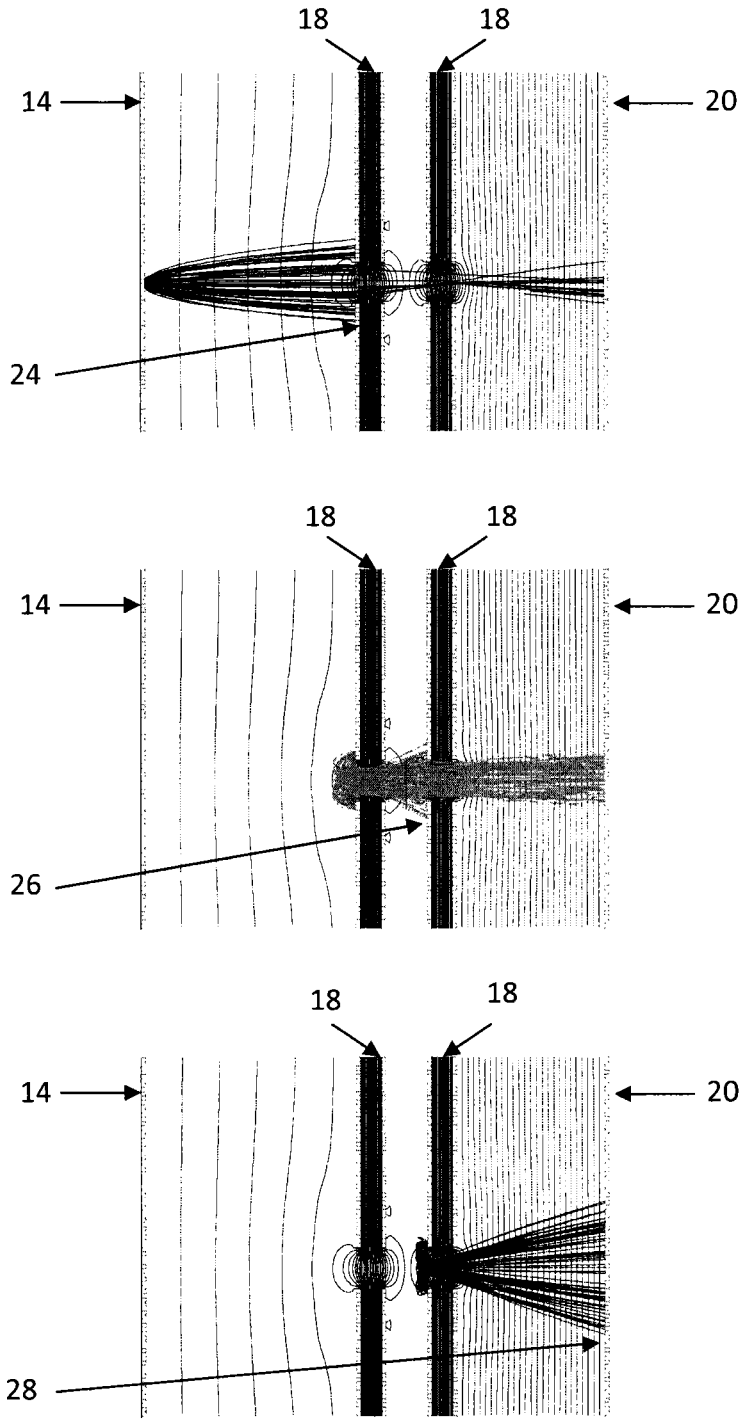
FIG. 2 is a schematic diagram illustrating simulation of electron trajectories through micro-structure boards.

Simulations have been done to show that the MPA can provide electron amplification similar to a conventional (or Multi-anode) PMT. These were done using SIMION, a standard code used for the design of electro-optical systems. FIG. 2 shows a schematic diagram of the simulations. Low-energy photoelectrons were assumed to be emitted over 2π steradians from the photocathode 14. These electrons strike the front face of the first microstructure board 18, as shown at reference point 24, releasing secondary electrons. The secondary electrons strike the second microstructure board 18, releasing additional secondary electrons, resulting in signal amplification, as shown at reference point 26. Secondary electrons from the second microstructure board 18 are transmitted to the anode (or alternately to additional MSBs for further amplification), as shown at reference point 28. The voltages on the both sides of this board were adjusted to attain an increase in the production of secondary electrons on the front surface of this board and to guide these low-energy secondary electrons through the channels of the board, where they gain additional energy due to the electric field in the channel. This process is repeated for the following boards. Thus, in each board after the first, there is a net gain ( ) of electrons per board. In these simulations, by using S-11 coatings on the microstructure board, we attained a net gain of approximately 2.5 times per board. Thus, a series of n microstructure boards will provide an overall gain of ( )". For 10 stages, a typical gain of a 104 can be attained. This is sufficient for many radiation sensors of interest to radiation detection and spectroscopy. Of course, optimizing the design of the MSB can lead to higher gains per stage and the use of more stages will lead to higher overall gain. By using pad readout, high quality imaging of objects of interest to medical physics or homeland security can be attained. By using a single anode plate 20, the MPA functions essentially as a large-area PMT.

The invention claimed is:

1. A photomultiplier assembly suitable for enabling the effective conversion of light signals into readily-detectable electrical signals comprising:

a photocathode adapted to convert light into electrons that is positioned in front of or on the front surface of the assembly;

at least one electron-multiplying plate made from an insulating substrate which does not emit sufficient contaminants to poison said photocathode, said plate being coated on the front and rear faces with a conductive layer, said front face of each plate is further coated with a layer of secondary electron-emissive material which, when struck by an incoming electron, produces secondary electrons, said plate being perforated with channels which have non-conducting walls, the number and geometry of these channels being adapted to promote the efficient transfer and acceleration of electrons through the channels under an applied voltage differential across said plate, at the exit of the last plate, there being an anode positioned to collect the electrons and generate an electrical signal adapted to be read by conventional electronic means, the photocathode, the electron-multiplying plate, or series of plates, and the anode all being contained within a vacuum enclosure.

2. The assembly as defined in claim 1, wherein the anode is a simple anode or a position-sensitive anode.

3. The assembly as defined in claim 1, wherein the spacing between the photocathode, the electron-multiplying plates, and the anode is selected to promote the efficient transfer and acceleration of electrons across the assembly, as well as to promote the efficient production of secondary electrons.

4. The assembly as defined in claim 1, wherein the number of plates placed in series is determined by the desired degree of electron multiplication.

* * * * *